US005094304A

United States Patent [19]

Briggs

[11] Patent Number: 5,094,304

[45] Date of Patent: Mar. 10, 1992

[54] DOUBLE BEND POSITIVE POSITIONING DIRECTIONAL DRILLING SYSTEM

[75] Inventor: Gary M. Briggs, Houston, Tex.

[73] Assignee: Drilex Systems, Inc., Houston, Tex.

[21] Appl. No.: 587,882

[22] Filed: Sep. 24, 1990

[51] Int. Cl.[5] ..... E21B 07/08

[52] U.S. Cl. ..... 175/61; 175/76; 175/325.3

[58] Field of Search ..... 175/61, 73, 76, 74, 175/75, 325

[56] References Cited

U.S. PATENT DOCUMENTS

| | | | |
|---|---|---|---|
| 2,167,194 | 7/1939 | Anderson . | |
| 2,316,409 | 4/1943 | Downing . | |
| 2,712,434 | 7/1955 | Giles et al. . | |
| 2,891,769 | 6/1959 | Page, Sr. et al. . | |
| 3,092,188 | 6/1963 | Farris et al. . | |
| 3,098,534 | 7/1963 | Carr et al. | 175/73 |
| 3,129,776 | 4/1964 | Mann . | |
| 3,248,449 | 1/1967 | Bachman et al. . | |
| 3,370,657 | 2/1968 | Antle . | |
| 3,424,256 | 1/1969 | Jeter et al. . | |
| 3,561,549 | 2/1971 | Garrison et al. | 175/76 |
| 3,593,810 | 7/1971 | Fields | 175/61 |
| 3,595,326 | 7/1971 | Claycomb | 175/73 |
| 3,974,886 | 8/1976 | Blake, Jr. | 175/76 |
| 4,015,673 | 4/1977 | Craig, Jr. et al. | 175/61 |
| 4,076,084 | 2/1978 | Tighe | 175/73 |
| 4,185,704 | 1/1980 | Nixon, Jr. | 175/76 |
| 4,270,619 | 6/1981 | Base | 175/61 |
| 4,305,474 | 12/1981 | Farris et al. | 175/73 |
| 4,319,649 | 3/1982 | Jeter | 175/73 |
| 4,388,974 | 6/1983 | Jones, Jr. et al. | 175/325 |
| 4,407,374 | 10/1983 | Wallussek et al. | 175/24 |
| 4,465,147 | 8/1984 | Feenstra et al. | 175/61 |
| 4,471,843 | 9/1984 | Jones, Jr. et al. | 175/73 |
| 4,492,276 | 1/1985 | Kamp | 175/61 |
| 4,501,336 | 2/1985 | Kemp et al. | 175/61 |
| 4,560,013 | 12/1985 | Biemgraben | 175/73 |
| 4,572,305 | 2/1986 | Swietlak | 175/325 |
| 4,623,026 | 11/1986 | Kemp et al. | 175/76 |
| 4,635,736 | 1/1987 | Shirley | 175/76 |
| 4,638,873 | 1/1987 | Wellborn | 175/73 |
| 4,715,452 | 12/1987 | Sheppard | 175/51 |
| 4,715,453 | 12/1987 | Falgout, Sr. et al. | 175/73 |
| 4,739,842 | 4/1988 | Kruger et al. | 175/61 |
| 4,770,258 | 9/1988 | Falgout, Sr. | 175/73 |
| 4,807,708 | 2/1989 | Forrest et al. | 175/45 |
| 4,819,760 | 4/1989 | Petermann | 166/212 |

FOREIGN PATENT DOCUMENTS

| | | |
|---|---|---|
| 0163946 | 12/1985 | European Pat. Off. . |
| 2121453A | 12/1983 | United Kingdom . |

*Primary Examiner*—Terry Lee Melius

*Attorney, Agent, or Firm*—Edgar A. Zarins; Malcolm L. Sutherland

[57] ABSTRACT

A selectively adjustable double bend positive positioning directional drilling system for kickoff from a main well bore to change the directiion of drilling. The tool is selectively adjustable to facilitate running into the vertical well bore and subsequently to provide an aggressive build rate upon kickoff. The tool string incorporates a pair of kickoff pads—a lower fixed pad and an upper rotatively adjustable pad. As the tool is run into the well bore the adjustable pad is oriented away from the bend in the motor housing. Once in the hole, the string would be rotated relative to the adjustable pad by the reactive torque of the downhole motor and locked in the desired orientation. The adjustable pad incorporates an internal slot system to guide rotation and lock the pad in position. Alternatively, a single arm underreamer-type assembly could be used as the upper kickoff pad.

18 Claims, 3 Drawing Sheets

DOUBLE BEND POSITIVE POSITIONING DIRECTIONAL DRILLING SYSTEM

BACKGROUND OF THE INVENTION

I. Field of the Invention

This invention relates to directional drilling systems and, in particular, to a selectively adjustable bent motor housing string which provides aggressive kickoff angles from the primary well bore.

II. Description of the Prior Art

Directional drilling techniques have become increasingly important for maximizing drilling success while lowering costs. Directional drilling most basically involves kicking off at an angle from a vertical well bore until a desired angle and/or horizontal position is attained allowing drilling across petroleum deposits maximizing production through a single well. It is desirable to minimize the radius of the directional drilling by maximizing the build rate achieved by the bent motor string Factors which affect the build rate include the stiffness of the drill string, the length of the motor housing and the position of the contact points of the drill string in relation to the drill bit and the bend of the motor housing.

Past drilling systems have incorporated various means for directing the drilling from the main well bore. The most basic structures include one or more stabilizers, a drill bit and a bent motor housing (or, alternatively, a drilling motor with a separate bent housing). When straight downhole drilling is desired the entire string is rotated to work the bit. At the point of kickoff, rotation of the full string is stopped and the drilling motor only is operated The deviation angle build rate will depend upon the placement and size of the stabilizers which push off from the walls of the well bore to direct the drill bit. Eccentrically mounted stabilizers have been employed to try and increase the kickoff from the walls of the well. Although such assemblies provide good deviation angles, the angle build rate is limited by the size of the stabilizer pads which must fit in the well hole. Increased kickoff pads sizes require larger initial well bores to prevent premature deviation. Moreover, in the case of eccentric stabilizers it is desirable to position the kickoff pads of the lowermost stabilizers in opposite orientations to increase the kickoff angle. However, this increases the effective diameter of the drill string which could hang up in the hole.

SUMMARY OF THE PRESENT INVENTION

The present invention overcomes the disadvantages of the prior known drilling systems by incorporating a selectively adjustable stabilizer to increase the deviation build rate of the drill string.

The drilling system of the present invention generally includes a drill bit at the end of the drill string, a bent drill motor housing or a drill motor and bent housing, and at least two kickoff pads one of which is selectively orientable to increase the build rate of the deviated hole. As the drill string is run into the well hole during conventional drilling operations the kickoff pads are oriented on the same side of the drill string thereby minimizing the effective diameter of the drill string. When directional drilling is to be initiated, the upper kickoff pad is reoriented such that the pad is diametrically opposite from the orientation of the lower pad. As directional drilling is initiated using the downhole motor, the reoriented upper kickoff pad will force the upper pad into the wall of the hole which in turn forces the lower pad to act as a fulcrum point against the wall and therefore increasing the build rate of the offset hole. This increased build rate will be maintained as the drill string travels through the deviated hole.

The present invention contemplates two assemblies for the upper contact point which selectively minimize the drill string diameter during conventional drilling and provide for an increased build rate during directional drilling. In a first embodiment, the upper kickoff comprises an eccentric stabilizer pad rotatively mounted to the drill string. The stabilizer includes a sleeve having the pad integrally formed thereon and through which the drill string passes. The sleeve includes a U-shaped slot which receives a pin on the string to control the orientation of the stabilizer pad. The reactive torque from the drill motor is used to rotate the drill string inside the pad assembly which is held in place by the walls of the well hole. Once the orientation relationship of the pad is altered, the cooperating U-shaped slot and pin hold the string components in proper orientation. In an alternative embodiment, the upper contact point is formed by a selectively deployable arm which pushes off from the wall of the well. Once directional drilling is to be initiated the arm is deployed by supplying hydraulic pressure.

Other objects, features, and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the view and in which.

DETAILED DESCRIPTION OF A PREFERRED EMBODIMENT OF THE PRESENT INVENTION

Figure 1:
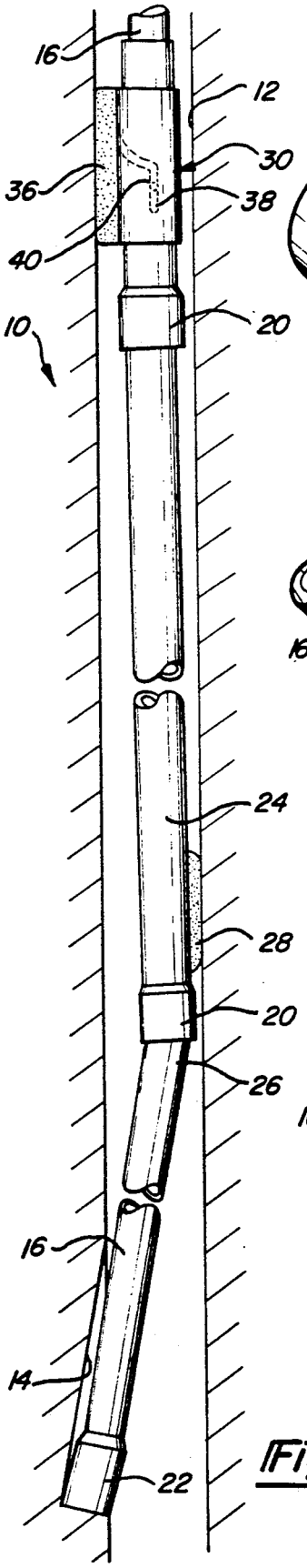
FIG. 1 is a perspective view of a directional drilling system embodying the present invention deployed within a well hole.
Figure 2:
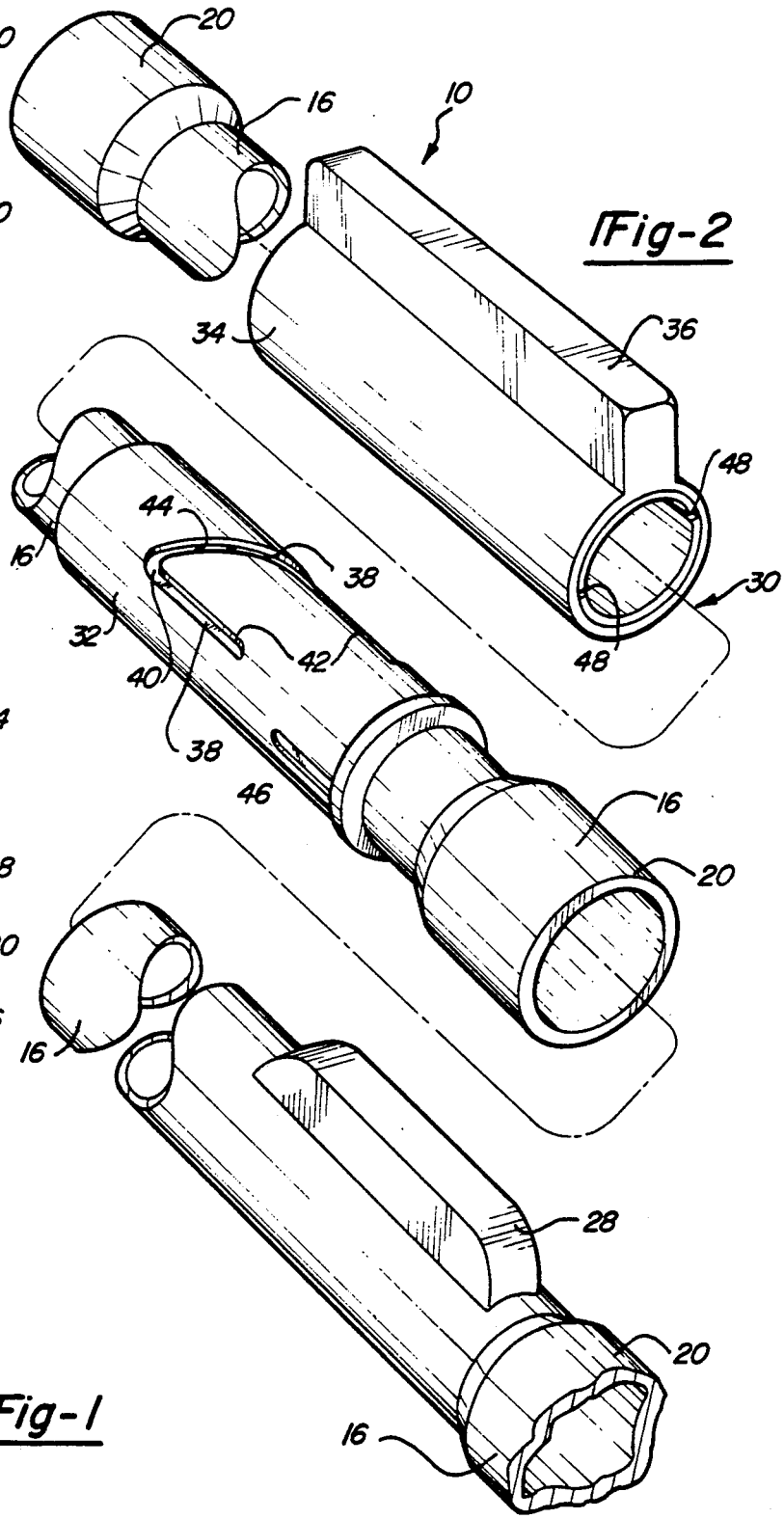
FIG. 2 is an exploded view of the stabilizer system of the present invention.

Referring first to FIGS. 1 and 2 there is shown an assembly 10 for selectively controlling the direction of drilling in a well bore 12 for forming an offset borehole 14 having an aggressive build rate in order to attain a precise non-vertical borehole 14. As with many directional drilling systems 10, the present invention generally includes a drill string 16 comprising a plurality of drill pipe sections 18 joined by mating pin and box structures 20, a drill bit 22 at the downhole end of the drill string 16 for forming the well bore 12, and a downhole drilling motor 24 which may include an integral bent housing 26. Alternatively, the drilling motor 24 and the bent housing 26 may be separate components, as will be described in greater detail herein. During drilling of the primary borehole 12, the full string 16 is rotated and the drilling motor 24 operated to drive the drill bit 22 in a generally vertical orientation. Subsequently, to form the offset bore rotation of the string 16 is stopped and only the drilling motor 24 is used to drive the drill bit 22.

Figure 3:
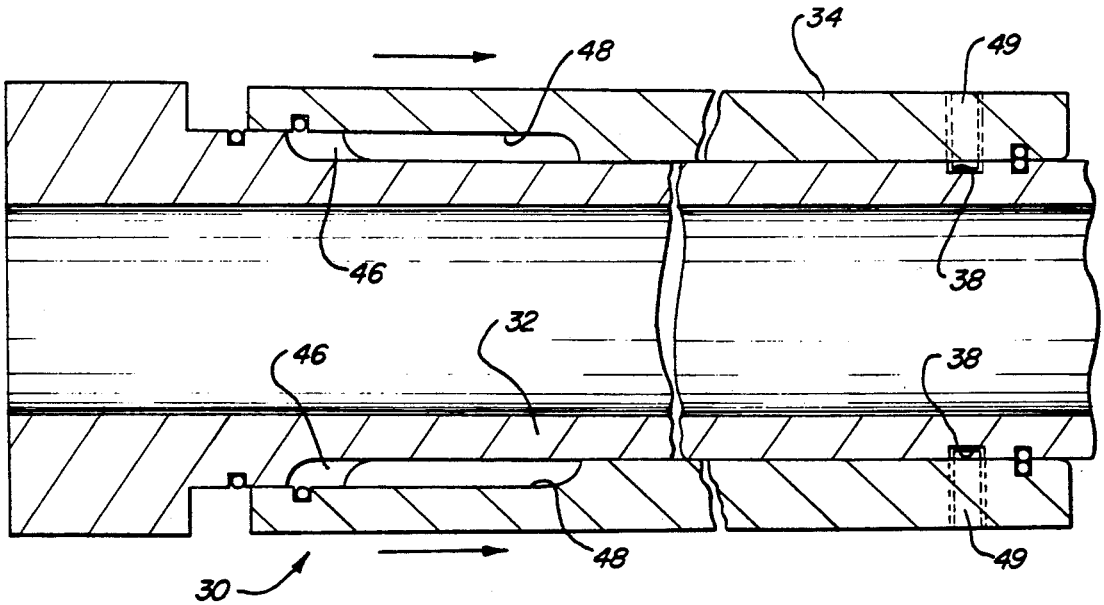
FIG. 3 is a cross-sectional view of the orientable stabilizer of present invention.

Referring now to FIGS. 2 and 3, the directional drilling system 10 of the present invention incorporates a series of kick pads which form the points of contact between the drill string 16 and the wall of the borehole 12 thereby directing the drill string 16 away from the wall. In a preferred embodiment of the invention, the drilling system includes at least one fixed kick pad 28 associated with the drilling motor 24 and bent housing 26. The motor pad 28 is aligned with the outside of the bend associated with the drilling motor 24 in order to drive the drill bit 22 into the opposite wall during directional drilling. In order to enhance the build rate, a selectively deployable contact point 30 is incorporated into the drill string 16, preferably above the drill motor 24. It is essential that the contact point 30 be ensured to obtain the desired predictable aggressive build rate.

In a first embodiment of the invention, the upper selectively engageable contact point 30 comprises an adjustable kickoff pad assembly including an inner sleeve 32 free to rotate on the drill string 16 and an outer sleeve 34 rotatably mounted to the inner sleeve 32. The outer sleeve 34 has a kick pad 36 formed thereon for contact with the wall of the well bore. The inner sleeve 32 includes a control groove 38 which receives a pin 40 on the outer surface of the drill string 16 to guide the rotational movement of the kick pad assembly 30. The groove 38 preferably includes a pair of longitudinal legs 42 joined at their upper ends by a lateral leg 44. The lateral leg 44 is at approximately a 45° angle relative to the longitudinal legs, which results in a relative longitudinal displacement of the longitudinal legs 44. This displacement, and intersection angle, allows for the selective orientation of the kick pad assembly and promotes retention of the desired positioning during drilling operations and pipe tripping. Thus, the inner sleeve 32 and the outer sleeve 34 will first move as a unit longitudinally, rotate in accordance with leg 44 and again longitudinally to re-engage the assembly 30 with the kick pad 36 in the opposite orientation. In order to selectively prevent rotation of the outer sleeve 34 relative to the inner sleeve 32, the assembly 30 includes selectively engageable splines 46. In a preferred embodiment, the splines 46 are formed on the inner sleeve 32 and selectively engage corresponding slots 48 formed in the inner cylindrical surface of the outer sleeve 34. When the desired rotational orientation is completed between the inner and outer sleeves, the splines 46 will be re-engaged to prevent relative rotation and the assembly locked in place with the locking screws 49.

Figure 4:
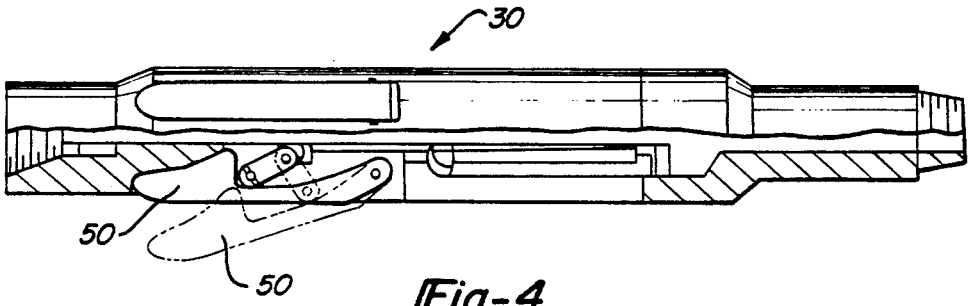
FIG. 4 is a partial cross-sectional view of an alternative embodiment of the selective kick-off tool used in the system of the present invention.

In a second embodiment shown in FIG. 4, the selectively deployable contact assembly 30 comprises a hydraulically actuable arm 50 in the nature of a single arm underreamer tool. As the drill string is run into the well bore 12, the arm 50 will remain in a retracted position. When directional drilling is to begin, hydraulic fluid is supplied to the assembly 30 causing the arm 50 to extend into engagement with the wall of the well. The hydraulically activated assembly 30 is oriented so that the kickoff arm will form a positive contact point against the wall opposite from the fixed kick pad 28 thereby causing the lower kick pad 28 to act as a fulcrum point in the well bore 12 in turn directing the drill bit 22 into the wall for offset drilling.

Figure 5:
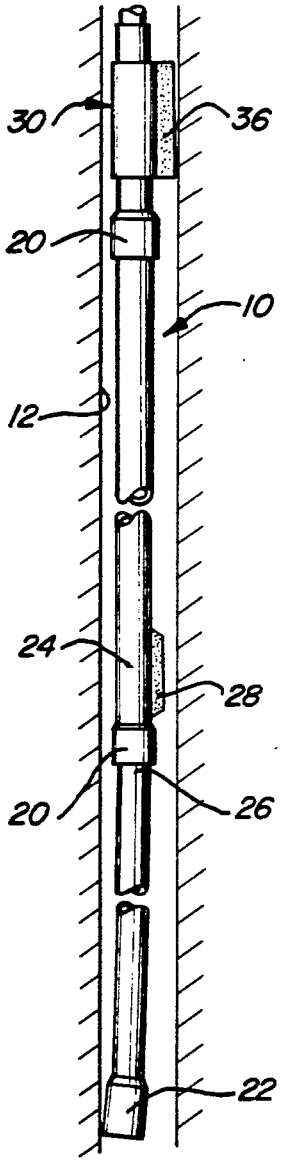
FIG. 5 is a perspective view of the directional drilling system in the well hole during drilling of the main well bore.
Figure 6:
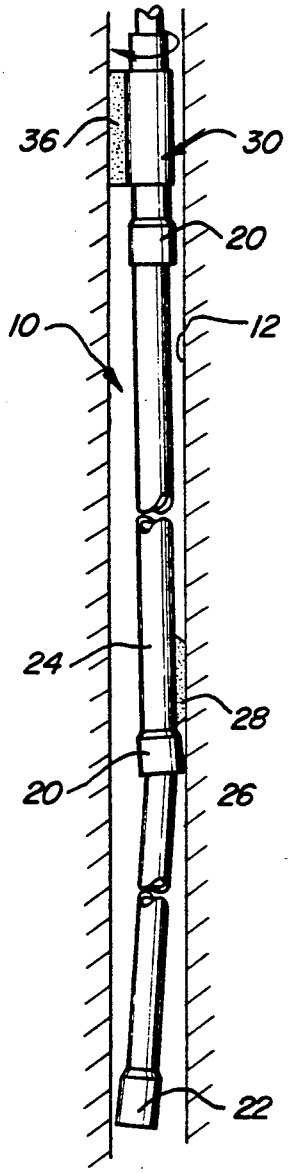
FIG. 6 is a perspective view of the directional drilling system in the well hole with the adjustable kick pad being reoriented.
Figure 7:
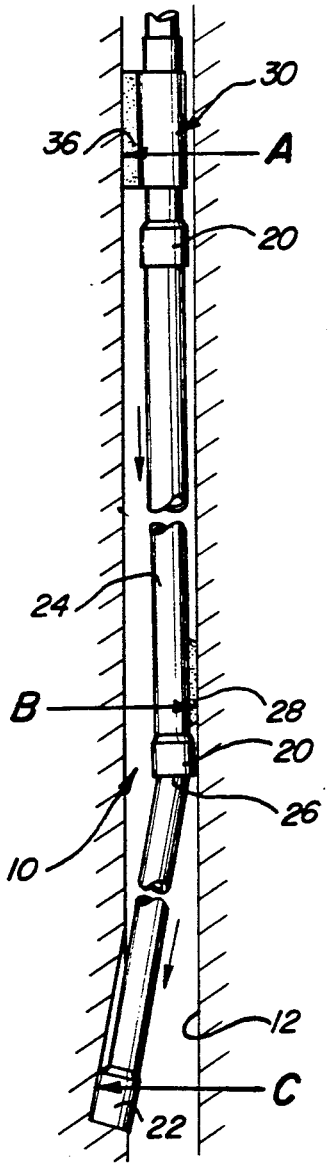
FIG. 7 is a perspective view of the directional drilling system in the well hole initiating the deviated well bore.
Figure 8:
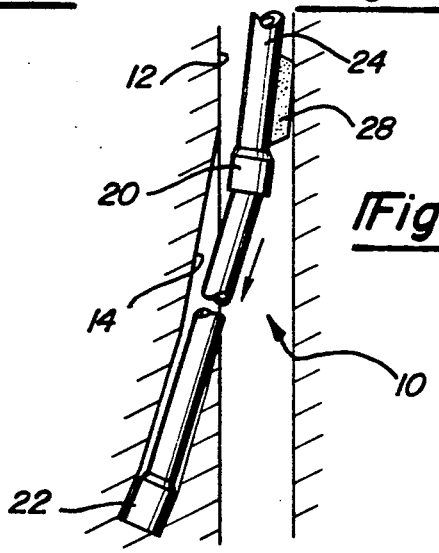
FIG. 8 is a partial perspective view of the directional drilling system drilling the deviated well bore.

The selectively deployable contact points facilitate running of the assembly 10 into the vertical well bore 12 and thereafter can be engaged to ensure three positive contact points for efficient directional drilling: at the drill bit, at the fixed contact, and at the upper contact. Referring now to FIGS. 5 through 8 the method of drilling the offset borehole 14 will now be described in conjunction with the first embodiment of the assembly 10. It should be understood that either selectively deployable contact point assembly can be used in this method to direct the lower contact against the wall of the well in order to increase the build rate of the offset well. As the drilling assembly 10 is run into the well 12, the orientable kick pad 36 is positioned on the same side of the drill string 16 as the fixed pad 28 and opposite from the bend in the string. This orientation minimizes the effective diameter of the drill string 16 allowing it to freely travel through the well bore 12 as the straight well is being drilled (FIG. 5). Once directional drilling is to be initiated, the upper pad 36 is rotated to the opposite side of the drill string 16 (FIG. 6). This is accomplished through the reactional torque of the drill string 16 as the pad 36 is held in place through engagement with the wall of the well. With the upper pad 36 oriented opposite from the lower pad 28, the effective diameter of the string is increased substantially. As weight is placed on the drill string 16, the flexibility of the drill pipe and contact by the pads 28, 30 with the wellbore will drive the drill bit 22 towards the wall at an increased angle (FIG. 7). By forcing the upper contact point A through the upper pad 30 the lower contact point B is ensured as a fulcrum point in turn driving the contact point C formed by the drill bit 22 at an increased angle. The secondary offset borehole 14 is thereby formed as the drilling motor 24 drives the bit 22 (FIG. 8). All three contact points will be maintained as the assembly 10 travels through the bore 14.

The foregoing detailed description has been given for clearness of understanding only as no unnecessary limitations should be understood therefrom as some modifications will be obvious to those skilled in the art without departing from the scope and spirit of the appended claims.

What is claimed is:

1. An assembly for controlling the direction of drilling in a well bore, said assembly selectively drilling a primary borehole and a secondary offset borehole, said assembly comprising:

a drill string having a drill bit at the down hole end thereof;

a downhole drilling motor mounted in said drill string for selectively drilling the offset borehole;

a bent housing associated with said drilling motor;

a first fixed kickoff pad mounted to said drill string above said bent housing, said first fixed kickoff pad engaging the wall of the borehole to direct said assembly away from the borehole wall; and a second adjustable kickoff pad mounted to said drill string above said first fixed kickoff pad to selectively direct said assembly away from the borehole wall; said second kickoff pad selectively adjustable relative to said drill string between a first non-engaging position during drilling of the primary well bore and a second engaging position during directional drilling whereby said second kickoff pad engages the borehole wall circumferentially opposite from the wall engaged by said first fixed kickoff pad to direct said drill bit at an offset angle to the primary borehole, said first fixed kickoff pad acting as a fulcrum for an increased offset angle to the primary borehole.

2. The assembly as defined in claim 1 wherein said second kickoff pad is rotatively adjustable relative to said drill string between said first position peripherally aligned with said fixed kickoff pad and said second position circumferentially opposed to said fixed kickoff pad whereby said second kickoff pad causes said first kickoff pad to act as a fulcrum point against the wall of the borehole in turn directing said drill bit into the opposing borehole wall for forming the offset borehole.

3. The assembly as defined in claim 2 wherein said adjustable kickoff pad includes an inner sleeve mounted to said drill string and free to rotate and an outer sleeve rotatively mounted to said inner sleeve, said outer sleeve having an offset kick blade integrally formed thereon.

4. The assembly as defined in claim 3 wherein said inner sleeve includes a rotation controlling slot which receives a pin of said drill string, said slot travelling along said pin during rotational adjustment of said second kickoff pad.

5. The assembly as defined in claim 3 wherein said inner and outer sleeves include cooperating splines selectively engageable to prevent rotation of said outer sleeve relative to said inner sleeve.

6. The assembly as defined in claim wherein said second adjustable kickoff pad comprises a selectively deployable kickoff arm, said kickoff arm extendable into engagement with the wall of the borehole to direct said first pad against the wall of the borehole in turn directing said drill bit into the borehole wall to form the offset borehole.

7. The assembly as defined in claim 6 wherein said kickoff arm is extendable upon increased hydraulic fluid pressure through s id drill string.

8. The assembly as defined in claim 1 wherein said bent housing forms a part of said downhole drill motor.

9. An assembly for controlling the direction of drilling in a well bore, said assembly selectively drilling a primary borehole and a secondary offset borehole, said assembly comprising:

a drill string having a drill bit at the downhole end thereof;

a downhole drilling motor having a bent housing associated therewith mounted in said drill string for selectively drilling the offset borehole;

a lower fixed kickoff pad mounted to said drill string above said bent housing, said lower pad selectively engaging the wall of the borehole to direct said drill bit into the borehole wall for directional drilling; and an upper selectively deployable kickoff pad mounted to said drill string to selectively direct said lower kickoff pad against the borehole wall and thereby act as a fulcrum point, said upper pad selectively rotatable relative to said rill string between a first non-engaging position aligned with said lower fixed kickoff pad during drilling of the primary well bore and a second non-aligned engaging position opposite said first position during directional drilling to direct said drill bit at an offset angle to the primary borehole.

10. The assembly as defined in claim 9 wherein said upper pad is relatively adjustable relative to said drill string and said fixed pad between said first position peripherally aligned with said fixed pad and said second position circumferentially opposed to said fixed pad such that said upper pad directs said assembly away from a first wall toward a second wall and said lower pad directs said drill bit into the first wall for forming the offset borehole.

11. The assembly as defined in claim 10 wherein said upper pad includes an inner sleeve rotationally mounted to said drill string and an outer sleeve having an offset kick blade formed thereon, said resulting assembly rotatively mounted to said drill string.

12. The assembly as defined in claim Il wherein said inner sleeve includes a control slot which receives a pin of said drill string, said slot travelling along said pin to adjust said upper kickoff pad in reaction to the torque generated by said drill motor.

13. The assembly as defined in claim 12 wherein said inner and outer sleeves include cooperating splines to selectively prevent rotation of said outer sleeve relative to said inner sleeve, said splines selectively engageable upon longitudinal shifting of said outer sleeve relative to said inner sleeve and locked in place.

14. An assembly for controlling the direction of drilling in a well bore, said assembly selectively drilling a primary borehole and a secondary offset borehole, said assembly comprising:

a drill string having a drill bit at the downhole end thereof;

a downhole drilling motor having a bent housing associated therewith mounted in said drill string for selectively drilling the offset borehole;

a lower kickoff pad mounted to said drill string above said bent housing, said lower kickoff pad selectively engaging the wall of the borehole to direct said drill bit into the borehole wall for directional drilling; and an upper selectively deployable kickoff arm mounted to said drill string in opposite non-aligned relation to said lower kickoff pad, said arm selectively extendable into contact with the wall of the borehole to cause said lower pad to function as a fulcrum against the opposite wall of the borehole in turn directing said drill bit into the borehole wall for forming the offset borehole.

15. The assembly as defined in claim 14 wherein said kickoff arm is hydraulically deployable to direct said drill bit into the wall of the borehole at an increased offset angle to the primary borehole.

16. A method of directional drilling at an increased offset angle to a primary borehole using a drill string having a bottom drill bit, a downhole drilling motor associated with a bent housing, a lower fixed contact point on the drill string above the bent housing and an upper selectively deployable contact point on the drill string above the lower fixed contact point, the method comprising:

lower said rill string while drilling the primary borehole by simultaneously rotating said rill string and operating said downhole drilling motor to rotate said drill bit;

while said drill string is till in the primary borehole, deploying said upper contact point to engage the borehole wall circumferentially opposite from the lower fixed contact point thereby causing said lower fixed contact point to engage the borehole wall to function as a fulcrum against the opposite borehole wall; and rotating only said drill bit by operation of said downhole drilling motor to drill an offset borehole having an increased radius of curvature, said lower contact point directing said drill bit along said offset angle to the primary borehole.

17. The method as defined in claim 16 wherein said upper contact point comprises a kick pad rotatable relative to said drill string, said deployment comprising rotating said drill string inside said kick pad in reaction to the torque of said downhole drilling motor from a first position peripherally aligned with said lower contact point to facilitate lowering of said drill string to a second circumferentially opposite position.

18. The method as defined in claim 16 wherein said upper contact point comprises a selectively extendable arm, said deployment comprising extending said arm into engagement with the borehole wall causing said lower contact point to act as a fulcrum point against the circumferentially opposite borehole wall in turn directing said drill bit at said offset angle.

* * * * *